US005111602A

United States Patent [19]

Risch

[11] Patent Number: 5,111,602

[45] Date of Patent: May 12, 1992

[54] BACKHOE CLAMP IMPROVEMENT

[76] Inventor: Joel V. Risch, 3275 Lucia Ave., Eureka, Calif. 95501

[21] Appl. No.: 558,880

[22] Filed: Jul. 26, 1990

[51] Int. Cl.[5] ..... E02F 3/76

[52] U.S. Cl. ..... 37/117.5; 37/DIG. 3; 37/DIG. 12; 414/739; 414/722

[58] Field of Search ..... 37/117.5, DIG. 3, DIG. 12, 37/2 R; 414/704, 722, 724, 739

[56] References Cited

U.S. PATENT DOCUMENTS

| | | | |
|---|---|---|---|
| 3,061,123 | 10/1962 | Rogers | 37/DIG. 3 X |
| 4,283,866 | 8/1981 | Ogawa | 37/117.5 |
| 4,285,628 | 8/1981 | Jankowski | 37/117.5 X |
| 4,375,345 | 3/1983 | Hanson | 37/117.5 X |
| 4,466,494 | 10/1984 | Hanson | 414/704 |
| 4,519,739 | 5/1985 | Risch | 37/DIG. 12 X |
| 4,804,309 | 2/1989 | Risch | 37/DIG. 12 X |
| 4,932,832 | 6/1990 | McCasland et al. | 414/722 |

FOREIGN PATENT DOCUMENTS

| | | | |
|---|---|---|---|
| 753998 | 8/1980 | U.S.S.R. | 37/DIG. 12 |
| 1106021 | 2/1970 | United Kingdom . | |
| 2043586 | 4/1981 | United Kingdom . | |
| 2083110 | 3/1982 | United Kingdom | 37/DIG. 3 |

*Primary Examiner*—Randolph A. Reese
*Assistant Examiner*—Spencer Warnick
*Attorney, Agent, or Firm*—Townsend and Townsend

[57] ABSTRACT

An improved backhoe clamping device is provided which is designed to be easily added onto standard existing backhoe equipment, and which allows full range of curl for the bucket through effectively hollow webbing between clamp arms. The device includes bucket links having integral mounting brackets, onto which clamp links are pivotally and substantially permanently attached, thereby offsetting their pivot points from the bucket links, and preventing loss of clamp links and removable pins. Clamp arms are pivotally attached to the clamp links by a single pin, this single pin also being used to secure the device in a storage position, preventing loss or misplacement of this pin. Clamp arms are also pivotally attached to the backhoe dipper arm. In this way, the existing backhoe leverage actuates the clamp arms, causing them to move in conjunction with the bucket to achieve a clamping effect. The webbing between clamp arms includes clamp link guides and clamp arm gussets, thus producing an advantageous meshing of the various parts and ensuring structural soundness.

13 Claims, 8 Drawing Sheets

BACKHOE CLAMP IMPROVEMENT

BACKGROUND OF THE INVENTION

This invention relates generally to excavating and construction equipment, and more specifically to attachments for backhoe equipment.

In the construction and excavation industry, many kinds of equipment have been developed to assist the workers in their numerous tasks. One piece of equipment that has achieved nearly universal acceptance in the industry is the wheel or track-mounted tractor equipped with a hydraulic backhoe and bucket. These machines can perform a variety of jobs, including lifting, trenching, clearing and excavation.

Some construction jobs, however, require a backhoe tool that can grip or clamp material from both sides, rather than just move or "scoop" the material from one side. For example, the picking up and placement of logs or pipe is best accomplished with a tool that provides a clamping effort.

Several types of backhoe attachments have been designed to achieve this clamping effect. Typically, the standard backhoe bucket is replaced with a completely self-contained clamping system including a pair of "jaws" each actuated by its own hydraulic cylinder. Alternatively, a second hydraulically actuated jaw can be added on to an existing single bucket system. Such systems do indeed achieve the required clamping effect, but they are very costly in that they require a second hydraulic unit, and often render the original backhoe equipment unsuitable for standard trenching-type operations. In addition, these attachments are often heavy and difficult to use, as well as highly vulnerable to damage.

Some backhoe attachment units have been developed which utilize a "stiff arm" portion which provides a fixed second jaw against which the movable backhoe bucket can clamp an object. However, these systems generally are limited in their range of motion, and hence have reduced application.

Of late, backhoe clamping attachments have been provided which can be easily added on to standard existing backhoe equipment. This type of clamping attachment mounts directly to the linkage and pivot points of a standard backhoe dipper and bucket, and converts the bucket to a clamping system by using the existing backhoe leverage to actuate a clamping jaw. Although these clamping devices require few parts, resulting in a product that is easy to manufacture, compact to ship and low in cost, these clamping attachments are inadequate in the respect that the bucket cannot "curl" all the way into the dipper arm, as if the clamping attachment were not attached to the backhoe. Also, these clamping attachments require the use of a removable "kidney link" and four removable pins to hold the kidney link to the backhoe. Frequently, the kidney link and pins which hold the kidney link to the backhoe are misplaced or lost.

FIGS. 1 and 2 present views of a prior art clamping device, over which the clamping device of the present invention is an improvement. Thus, FIG. 1 is a perspective view illustrating a prior backhoe clamping device 10 as mounted to a standard backhoe dipper and bucket arrangement. The clamping device includes right and left mounting brackets 12*a, b* (left mounting bracket 12*b* cannot be seen from this perspective), right and left link/bracket pins 14*a, b* (left link/bracket pin 14*b* cannot be seen from this perspective), right and left clamp link 16*a, b*, right and left clamp link pins 18 *a, b*, and right and left clamp arms 20*a, b*. In this conventional arrangement, clamp arms 20*a, b* are secured to each other by a plate 22, and to the dipper and bucket arrangement by a clamp/dipper pin 24. The disadvantages of this arrangement will become apparent when the inventive clamping device is described below. Gripping protrusions or teeth 25 on the clamp arms improve the clamping ability, and are a standard item.

The pertinent parts of the original backhoe dipper and bucket arrangement include a dipper arm 30, a lower side bucket link pin 32, right and left side bucket links 34*a, b*, and upper side bucket link pin 36, a hydraulic cylinder shaft 38, a bucket linkage 40, a bucket linkage/bucket pin 42, and a bucket 44.

In a prior method of attaching the clamping device, right and left mounting brackets 12*a, b* are first welded or otherwise secured to the outside surfaces of the right and left side bucket links 34*a, b*, respectively. When welding these mounting brackets 12*a, b*, proper placement of the mounting brackets is critical, for it is from the offset pivot effect to the clamp link 16*a, b* that the backhoe clamping device gets its desired results. It is preferable to locate the brackets to maximize the resultant clamp leverage with the available amount of stroke. Thus, one must place the pivot point of the link/bracket pins 14*a, b* below and to the side of the center of the bucket of the side bucket links 34*a, b*, the movement of the bucket links generating several times the clamping force at the clamp arms than would be generated by a pivot point placed in the center of links 34*a, b*. Once this mounting bracket is properly positioned and welded into place, the rest of the backhoe clamping device is then assembled.

FIG. 2 shows the prior clamping device in its stored position. To store the clamping device, the link/bracket pins 14*a, b*, clamp links 16*a, b* and clamp/link pins 18 *a, b* must be removed to enable the clamp arms 20*a, b* to be raised back until plate 22 contacts dipper arm 30. A chain 28, which is secured to plate 22, is then attached to a grab hook 31, which is welded to the dipper arm 30.

As can be seen with reference to FIGS. 1 and 2, this arrangement of the clamping device presents certain disadvantages: welding of the mounting brackets 12*a, b* requires experience to know exactly where to mount the brackets to bucket links 34*a, b*; pins 14*a, b*, 18 *a, b* are completely removed, along with clamp links 16*a, b*, to be put somewhere such as a tool box, which may become separated from the backhoe; and when the clamping device is in its stored position as shown in FIG. 2, the bucket cannot curl to its full curl position (i.e., the bucket cannot travel to a full closed arc position without interference between the dipper arm and the clamp arm).

It would be advantageous to design a clamping device which is easily and quickly attached to a backhoe, in which the clamp link and associated pins remain attached to the backhoe in both a stored and operable condition. It would further be advantageous if the original bucket would have its full curl.

SUMMARY OF THE INVENTION

A backhoe clamping device is provided which is designed to be easily added on to standard backhoe equipment. The bucket link used with the clamping device has the ability to permanently retain a pair of clamp links by allowing the clamp links to be pivoted about a single pin inserted through two clamp links and two bucket links, allowing the clamp links to be pivoted to a position where they can be temporarily held in a nonoperable mode until they are needed. The clamping device requires few parts, resulting in a product that is easy to manufacture, compact to ship, and low in cost. The clamping device is easily and quickly brought from a stored condition to an operable condition, even with little experience on the part of the operator. The clamping device has fewer moving parts and fewer pieces to be lost than previous designs.

One method of attaching the clamping device to existing equipment requires only a simple drilling of a hole in the original equipment bucket link, and a simple welding operation. Alternatively, to avoid the single drill hole and welding operation, the replacement of a single original part (original equipment bucket link) of the standard backhoe can be used to modify a backhoe. In both methods of attaching the clamping device, the original bucket/dipper arm pin of the standard backhoe must be replaced as it now must accommodate the added width of the clamp arms of the clamping device.

A further benefit of this method of attachment is that the pivot point of the clamping device linkage is placed to maximize the mechanical advantage of the clamping device. This position known, the bucket link can be designed and drilled remote from the backhoe and the new bucket link installed onto the original backhoe, eliminating guesswork as to where to weld a separate mounting bracket.

The clamping device can also incorporate more than one set of positioning holes for its clamp arm linkages, thereby offering a variety of closure alignments, adding to its versatility.

A very important feature of the clamping device is that the clamping device is very close to the dipper arm when in the stored position. This allows the bucket to curl to its maximum closed position. (Current clamping devices can project as far as 10" or more from the dipper arm, restricting full bucket curl). The clamping device's ability to store snugly against the dipper arm is accomplished by a hollow, flat positioning of the center webbing. Careful design and placement of all of the pieces allows all of the parts to sandwich and mesh without creating any interference. Rigidity is maintained by using suitably designed reinforcements for the center webbing. When this clamping device is put into the stored position, all of the parts remain attached with the backhoe clamp assembly, thereby reducing the risk of losing or misplacing the parts. (In a previous design of the same inventor herein, U.S. Pat. No. 4,519,739, when the clamping device is placed into the stored position, the four kidney link pins and the kidney links themselves have to be completely removed.) To accomplish this, the clamping device uses one single long lower pin instead of separate right and left lower pins. When stored, this same pin is used to hold the clamping device into the stored position. The upper clamp link pins are pivotably and substantially permanently mounted to the bucket links so that they are removable only with the proper tools. When stored, the clamp links are pivoted up on the bucket links and retained there by a pin, wire or resilient notch.

Careful design and placement of the clamping device pieces so that the pieces sandwich and mesh together without any interference includes the provision of clamp link guides for the lower clamp link connections. These clamp link guides also ensure that the clamp links are in proper alignment with the bucket links.

A standard backhoe and bucket can thus be easily converted to a clamping-type tool. Thus converted, the backhoe can perform a number of tasks that a backhoe bucket alone could do only with considerable difficulty. For example, the backhoe clamping device enables the backhoe to perform tree and stump removal, log stacking and loading, rock removal and positioning (including rocks larger than the bucket itself), post-pulling or any other application requiring a clamping effort.

Further advantages and embodiments of the invention will be apparent from the following description.

DESCRIPTION OF THE SPECIFIC EMBODIMENTS

Figure 2:
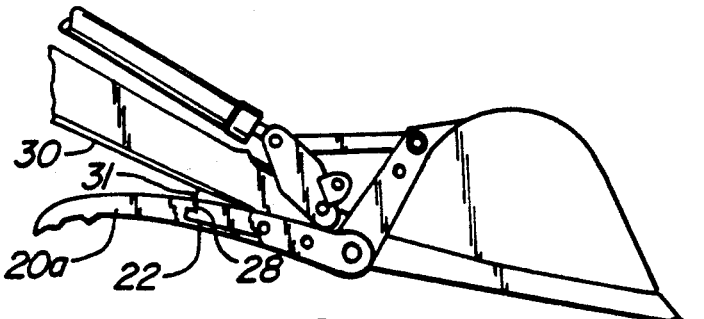
FIG. 2. PRIOR ART
FIG. 2 is an elevated side view of the backhoe clamping device of FIG. 1 in its stored position, showing the inability of the clamping device to allow the bucket to fully curl.
Figure 3A:
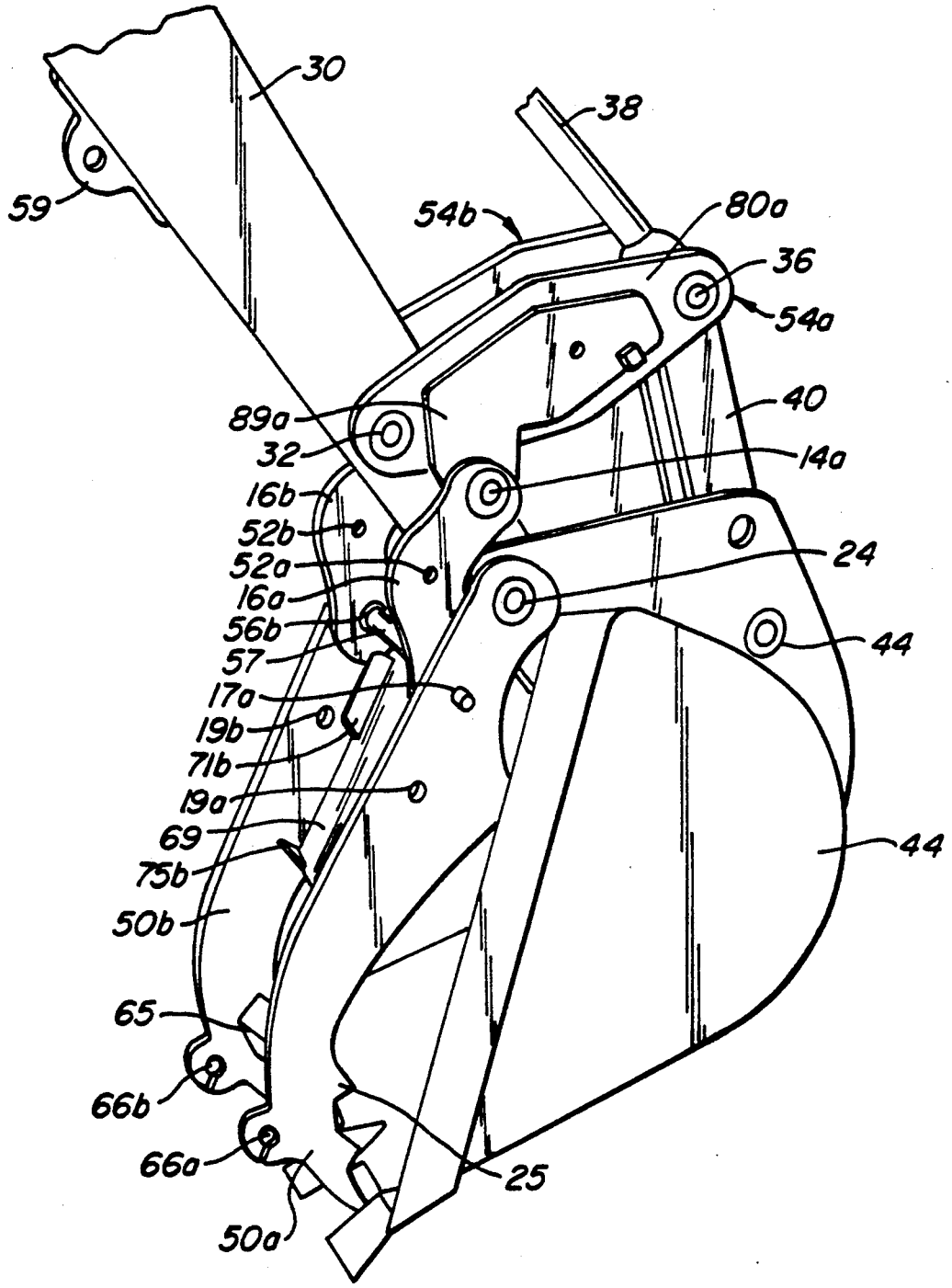
FIG. 3A is a perspective view of a backhoe clamping system in accordance with the principles of the present invention illustrating the clamping device extended in an operative position.
Figure 3B:
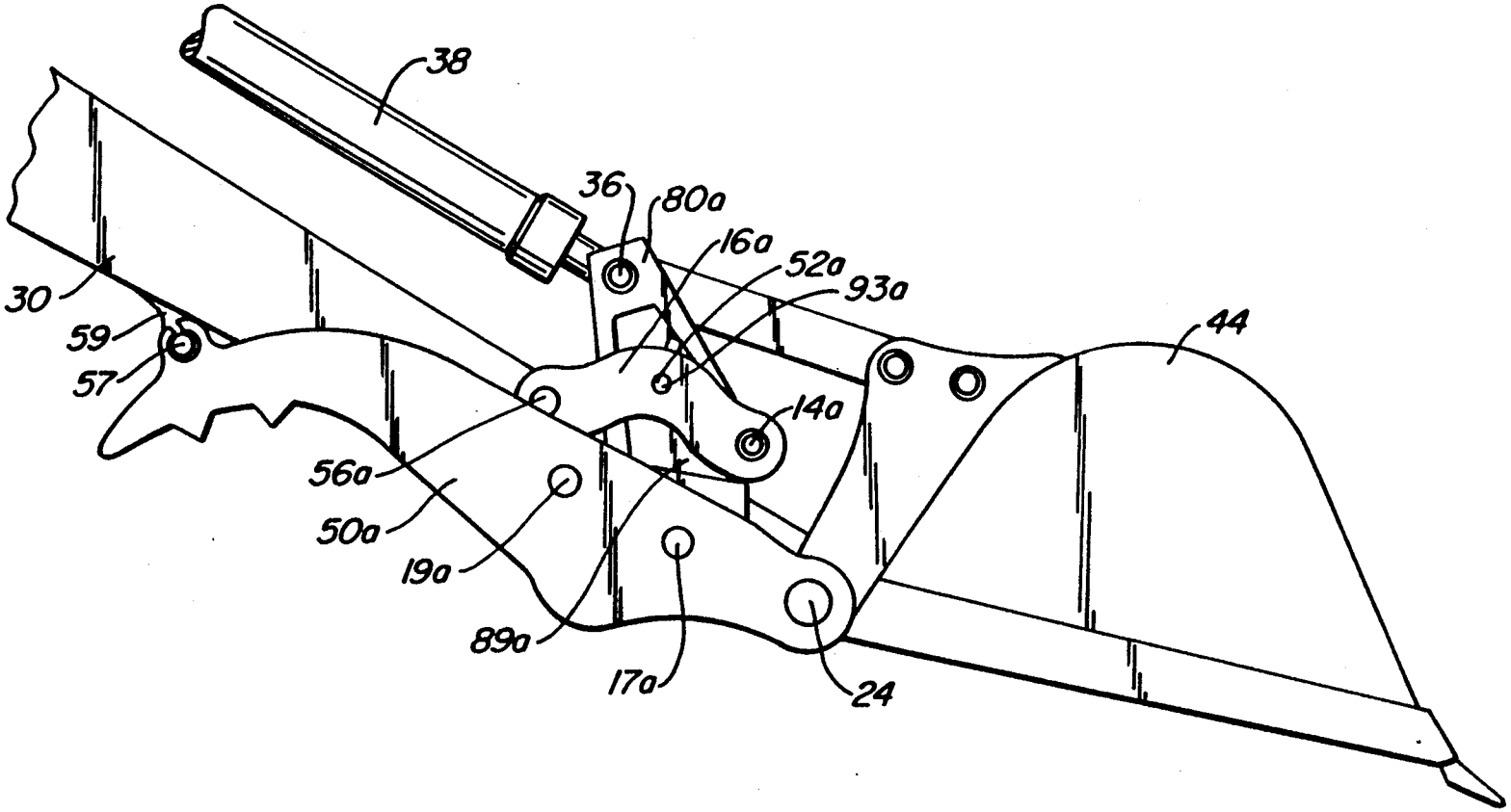
FIG. 3B is a side elevational view of the system illustrated in FIG. 3A showing the clamping arms secured in the retracted state and the bucket extended.
Figure 3C:
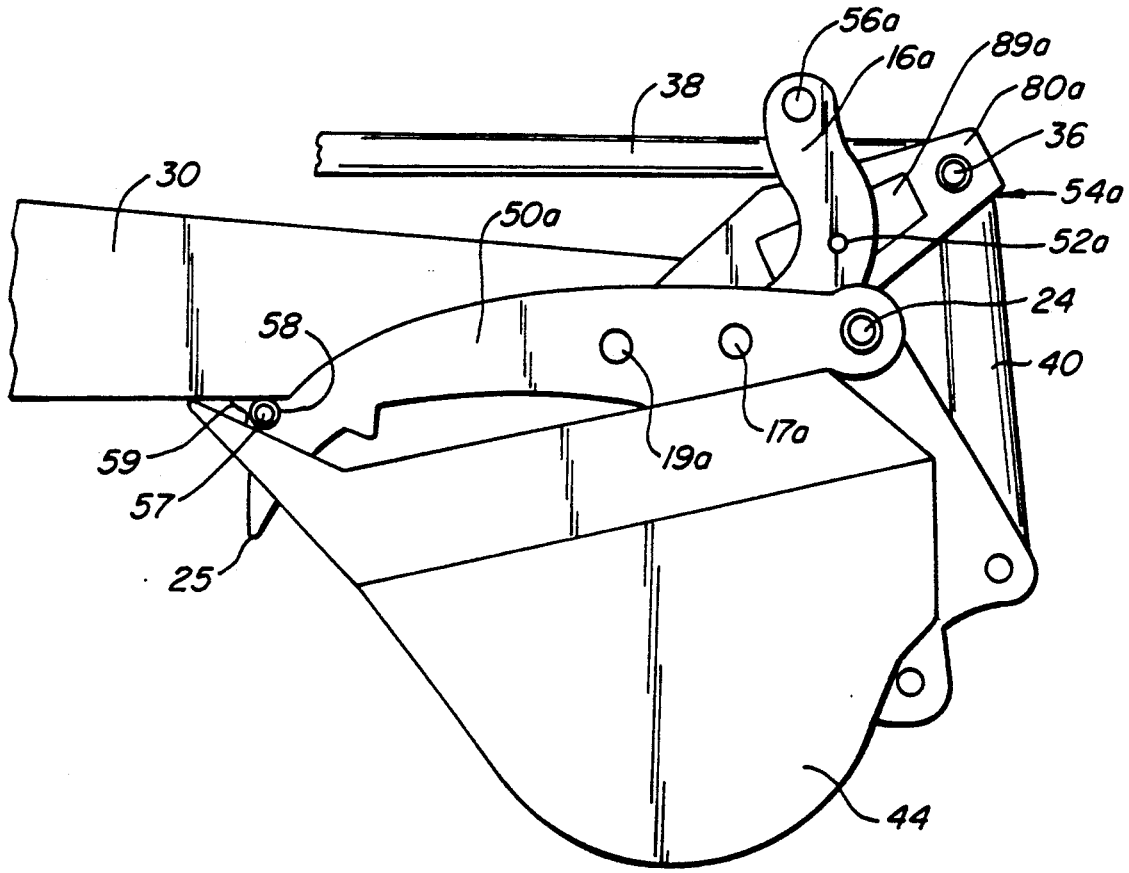
FIG. 3C is a side elevational view of the backhoe clamping system illustrated in FIGS. 3A and 3B showing the clamping arms secured in a retracted state and the bucket in full curl.

In order to overcome these disadvantages, the clamping device of FIG. 3 is provided. (Original equipment numbers are kept the same as in FIGS. 1 and 2.) As evident from the drawings clamp arms 50*a, b* mesh with dipper arm 30 to permit much more bucket curl when the bucket is in the stored position (FIG. 3C) than permitted in the prior art clamp arm arrangement illustrated in FIGS. 1 and 2.

Figure 1:
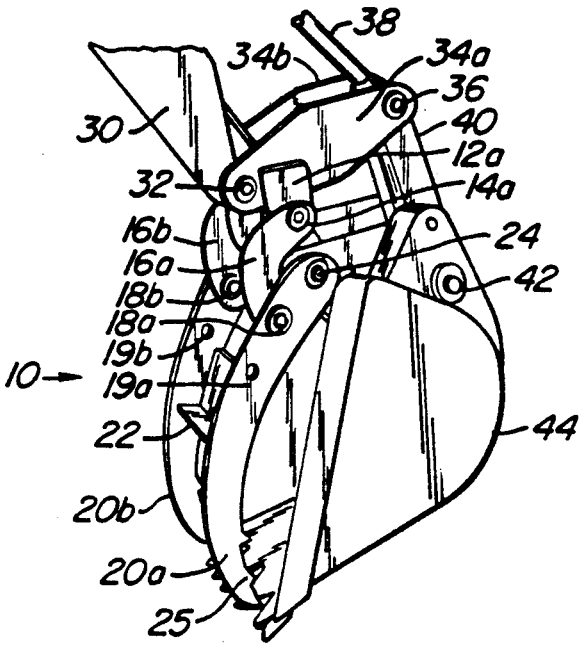
FIG. 1. PRIOR ART
FIG. 1 is a perspective view of a prior art backhoe clamping device as mounted on a typical backhoe dipper and bucket.

Throughout the drawings right-hand members are designated as "a", while left-hand members are designated as "b". Referring to FIG. 3C, clamp links 16*a, b* are in their pivoted position, and the clamping device is in its stored mode (clamp 166 is hidden from view). One difference between clamp links 16*a, b* from the clamp link of FIG. 1 is the addition of new clamp link holes 52*a, b* generally centered in clamp link 16*a, b*. "Holes" 52*a, b* may not be required to be centered in all embodiments, as this is a non-critical aspect of the invention. Indeed, "holes" 52*a, b* may be depressions, not entirely through holes. All that is required in this embodiment is that a depression exist to accommodate at least a portion of a pin. Clamp link bracket pins 14*a, b* extend through end portions of clamp links 16*a, b* and mounting brackets 89*a, b* of new bucket links 54*a, b* (discussed below with reference to FIGS. 7 and 8) to pivotally couple clamp links 16*a, b* to new bucket links 54*a, b*. Clamp arm 50*a, b* further include primary holes 17*a, b* and may include alternative holes 19*a, b* , as in the clamping device of FIG. 1 and 2. In one preferred embodiment, only primary holes 17*a, b* are provided.

As can be seen in FIG. 36, bucket 44 is in its fully curled position, even though the clamping device is still attached to the backhoe. When in the stored position the clamping device is secured to dipper arm 30 via a single clamp link pin 57. An important feature of the present invention is the fact that clamp link pin 57 is utilized in the operable mode as a clamp link pin to temporarily fix clamp link 16*a, b* to new clamp arms 50*a, b* , the single clamp link pin 57 replacing old clamp link pins 18 *a, b*. This gives the advantage that clamp link pin 57 and clamp links remain attached to the backhoe at all times, i.e., in both the storage and operational modes.

Figure 4:
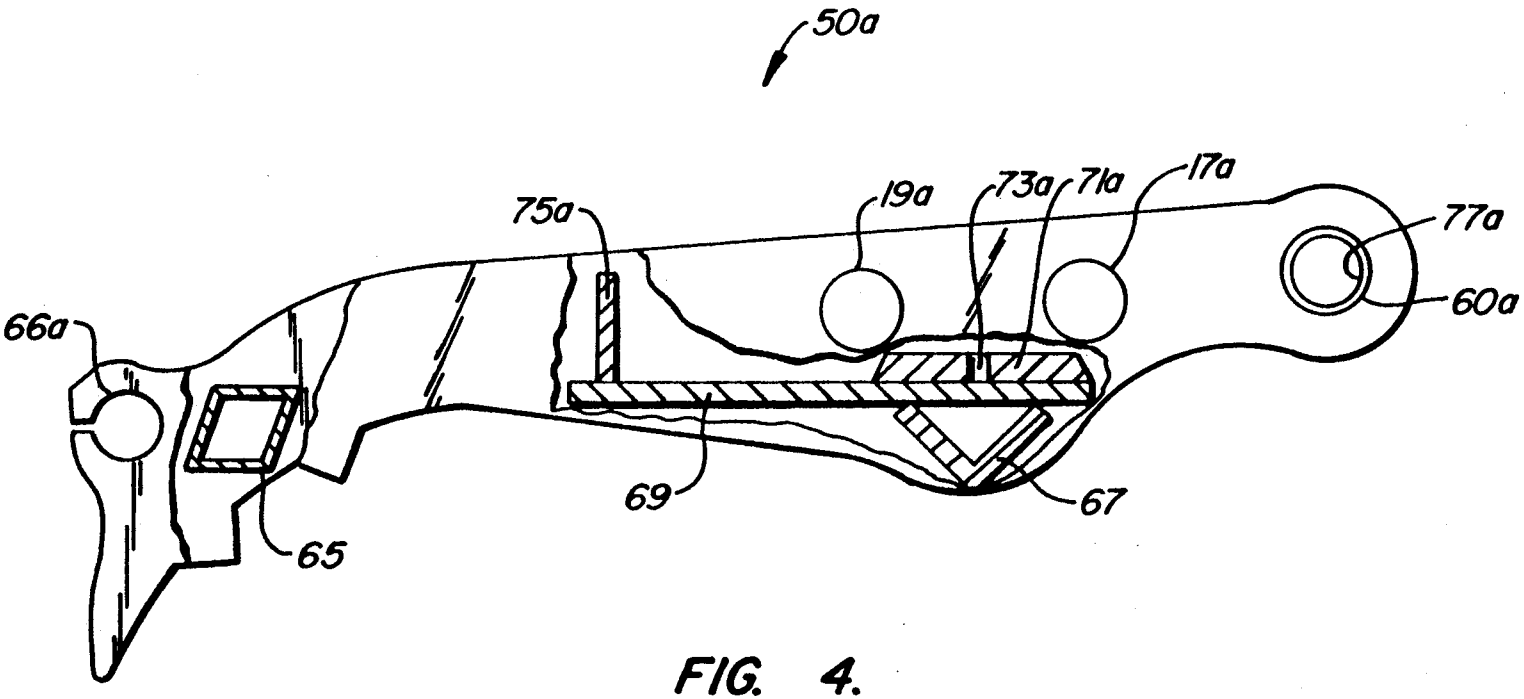
FIG. 4 is a side elevation, partially sectioned view of one clamp arm of the clamping device of the present invention, showing the various structural elements of the clamping device.
Figure 5:
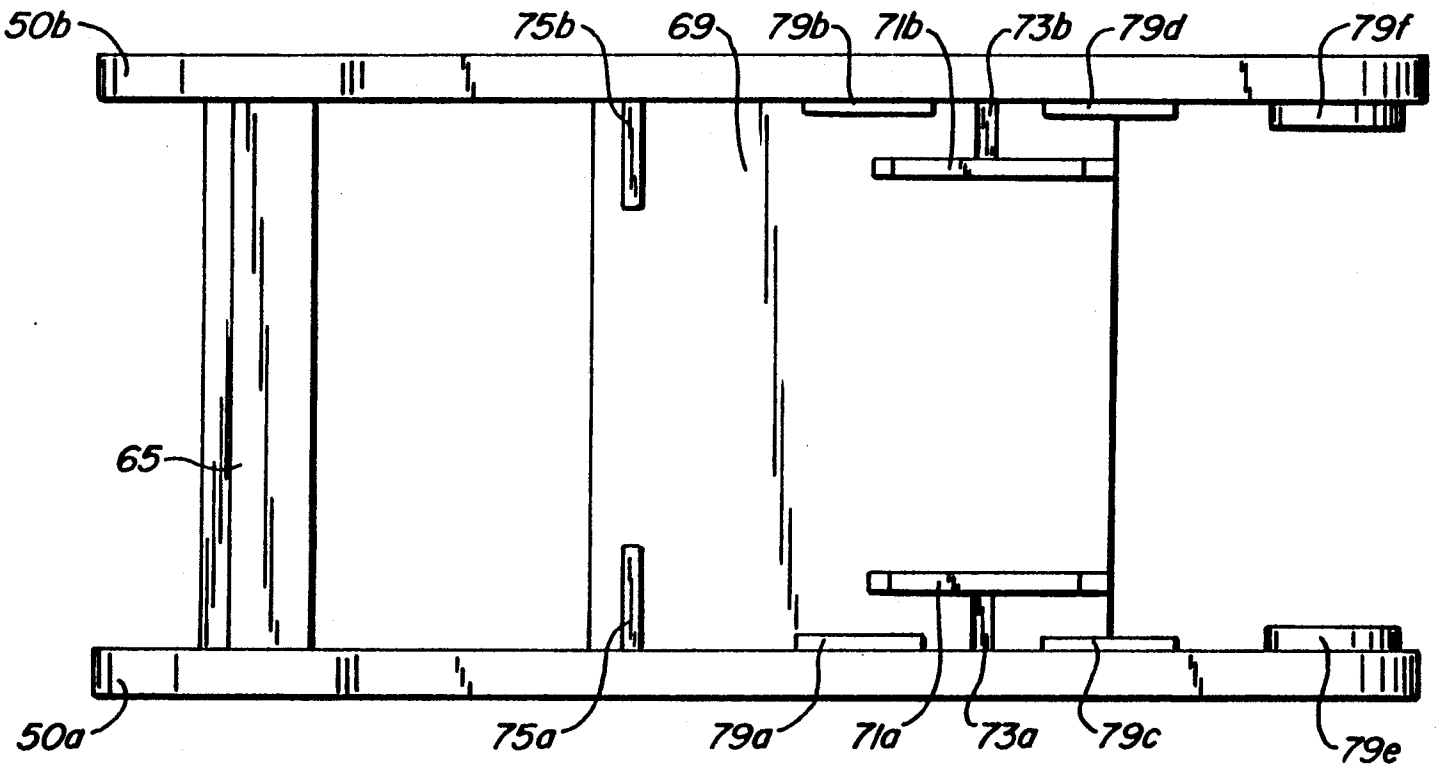
FIG. 5 is a top plan view of the clamping device according to the present invention.
Figure 6:
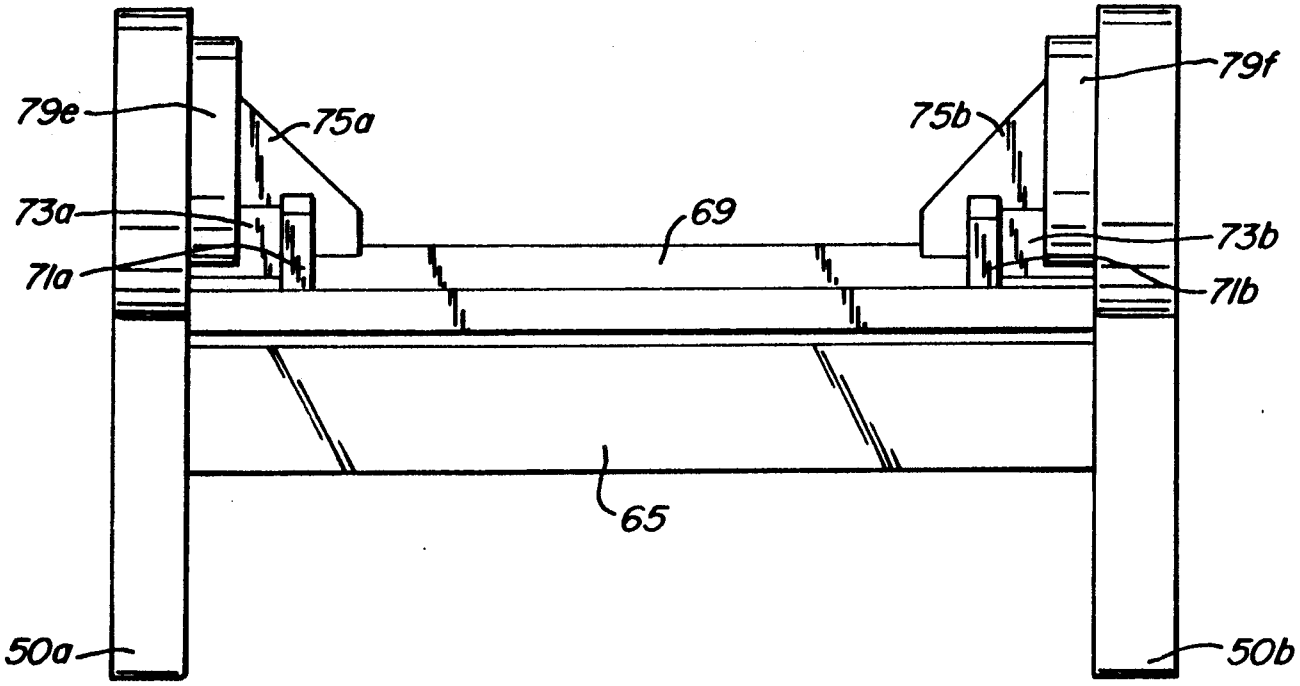
FIG. 6 is an end view of the clamping device, showing the relative shapes of the features of the clamping device.

New clamp arms 50*a, b* are shown in FIGS. 4–6 (clamp arm 50*a*, right side, only) showing structural details of support webbing which allow the clamping device to be efficiently stored and allow the bucket to curl to its natural position. Clamp arm 50*a* is partially cut away in the region showing a box tube stop 65 and bottom plate 69, both of which extend from clamp arm 50*a* to clamp arm 50*b* (perhaps most clearly shown in FIG. 5). Box tube 65 encounters dipper arm 30, acting as a stop member when bucket 44 is in a full curl position (FIG. 3C). Box tube 65 also gives structural support to clamp arms 50*a, b* center reinforcement 67, which in this embodiment is simply Throughout the drawings right-hand members are designated as "a", while left-hand are designated as "b". Referring to FIG. 3C, clamp links 16*a, b* are in their pivoted position, and the clamping device is in its. Clamp link bracket pins 14*a, b* extend through end portions of clamp links 16*a, b* and mounting brackets 89*a, b* of new bucket links 54*a, b* (discussed below with reference to FIGS. 7 and 8) to pivotally couple clamp links 16*a, b* to new bucket links 54*a, b* clearly shown in FIG. 5). Box tube 65 encounters dipper arm 30, acting as a stop member when bucket 44 is in a full curl position (FIG. 3C). Box tube 65 also gives structural support to clamp arms 50*a, b* "angle iron" which also extends from the inner surface of clamp arm 50*a* to the corresponding inner surface of clamp arm 50*b*, thereby lending structural support to the region of the clamping device in the area of primary holes 17*a, b* and alternate holes 19*a, b*. Clamp link guides 71*a, b* are shown as trapezoidal plates (FIG. 4 and 5). Clamp link guide 71*a* is spaced from the inner surface of clamp arm 50*a* such that a portion of clamp link 16*a* can fit between and mesh with clamp arm 50*a* and clamp link guide 71*a* (see FIGS. 3A and 5). Clamp link guide 71*b* is similarly spaced from the inner surface of clamp arm 50*b* such that a portion of clamp link 16*b* can fit between and mesh with clamp arm 50*b* and clamp link guide 71*b*. In this manner, clamp link guides 71*a, b* guide retracted to the stored position (see FIGS. 3A–C). Guide gussets 73*a, b* (in FIG. 5) provide support for the trapezoidal clamp link guides 71*a, b*. It will be noted by those skilled in the art that clamp link guide 71*a, b* may be shapes other than trapezoidal, such as rectangular or even square, as long as the clamp link guide serves the purpose of guiding portions of clamp links 16*a, b* as discussed above. Clamp links 16*a, b* may be "kidney shaped" or have an "S" shape in some embodiments. The particular shape will depend on the thickness and shape of clamp link guides 71*a, b*, and type of support webbing actually used for the clamping device. Further modification in clamp link shape may be required for backhoe dippers heretofore not encountered by the inventor herein. The thickness of trapezoidal clamp link guides 71*a, b* will be limited by the width of the dipper arm, which may vary from backhoe to backhoe.

Further shown in FIGS. 4–6 are clamp arm gussets 75*a, b* which function to support clamp arms 50*a, b*. Clamp arm gussets 75*a, b* have a slanted or sloped profile (FIG. 6) which helps guide the clamping device to mesh with dipper arm 30. Thus, the entire clamping device has an effectively hollow support webbing, heretofore not seen in the experience of the inventor. The term "hollow support webbing" as used herein is intended to means support webbing allowing meshing of arms 50*a, b* with dipper arm 30, as shown in FIGS. 3B and 3C, contrary to the nonmeshing arms shown in the prior art device of FIG. 2.

When the clamping device is placed in its retracted/stored position, clamp link pin 57 or alternative holes 19*a, b* and corresponding holes 56*a, b* in clamp links 16*a, b*. Then clamp link pin 57 is inserted into storage connection 66*a* and *b* of clamp arms 50*a, b*. Clamp link pin 57 is inserted first through storage connection 66*a*, then through clamp bracket 59 (FIGS. 3A–C), then passing through storage connection 66*b* on clamp arm 50*b*. Accordingly, clamp bracket 59, which is connected to dipper arm 30, includes a through hole for receiving clamp link pin 57. Alternatively, clamp link pin 57 may be inserted in reverse, i.e., through storage connection 66*b*, clamp bracket 59, then storage connection 66*a*.

Note that clamp link pin 57 can be removed from either the left-hand side or the right-hand side of the backhoe and can be inserted in storage connections 66*a, b* and clamp bracket 59 from either side of dipper arm 30.

Dipper/clamp pin holes 60*a, b* and clamp bushings 77*a, b* are essentially as in the device of FIG. 1 and 2. Various bushings are shown in FIG. 5 as 79*a, b, c, d, e, f*. These items are also essentially the same as the items in the device of FIGS. 1 and 2, and are purchased items.

Figure 7:
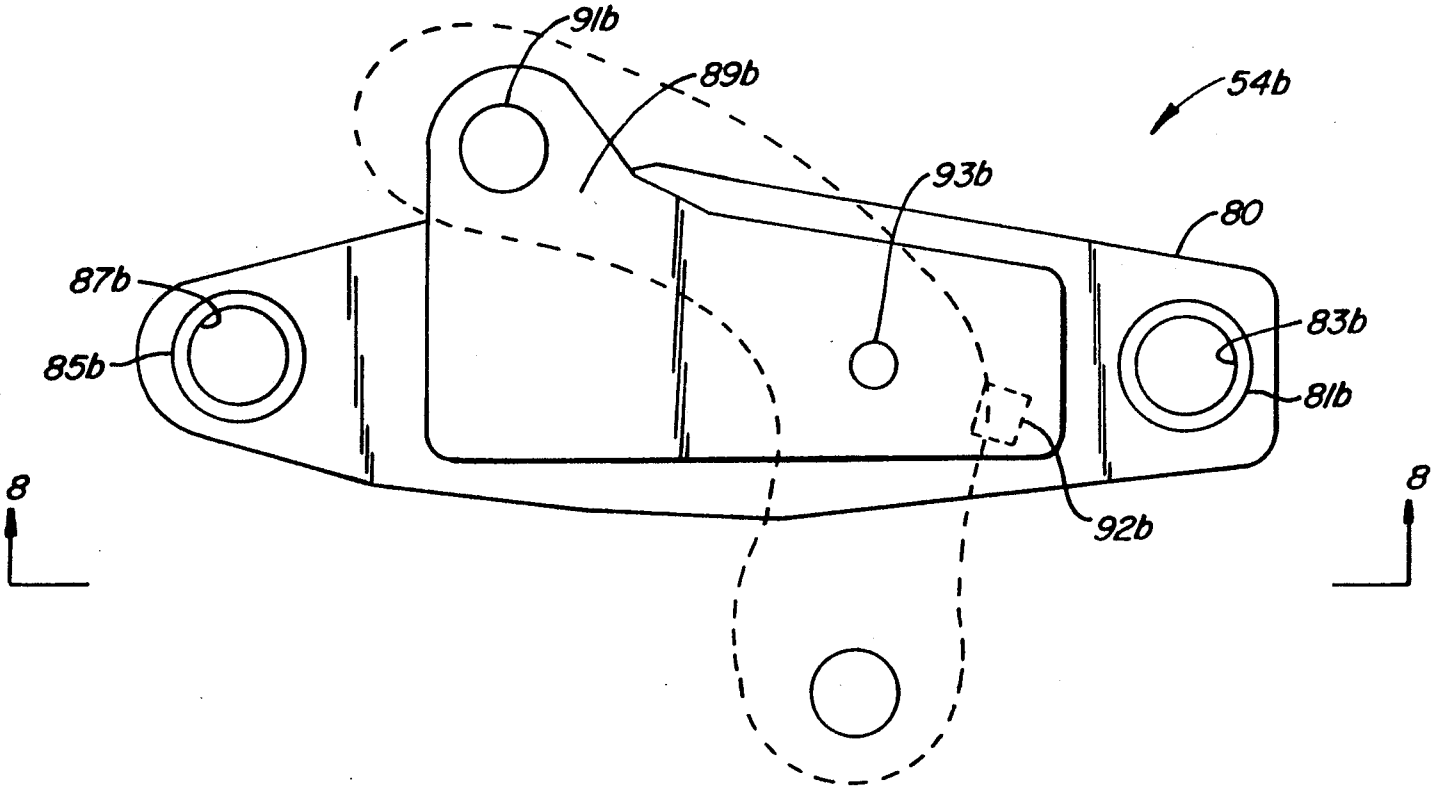
FIG. 7 shows one embodiment of a bucket link which can be used with the clamping device described herein.
Figure 8:
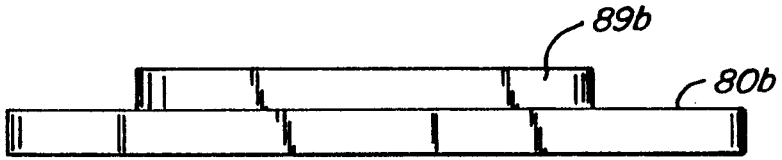
FIG. 8 shows an end view of the bucket link of FIG. 7, also showing in phantom one embodiment of a clamp link.

FIGS. 7 and 8 show one embodiment of a bucket link in accordance with the present invention as an integral bucket link 54*b* (a similar construction would be shown for 54*a*, the right-hand bucket link). Bucket link 54*b* comprises two members in this embodiment, a main bucket link 80*b* and secondary bucket link 89*b*. (Alternative embodiments include integral bucket links of one machined or cast piece, these methods being well known.) Secondary bucket link 89*b* can be attached to main bucket links 80*b* by suitable means, such as welding, brazing or soldering, welding being the method of choice, due to its ease of use and generally well-known techniques. In this embodiment of the invention, to avoid the possibility of not obtaining an optimal position of mounting brackets 12*a, b* in FIG. 1, the bucket links of the FIG. 1 clamping device (34*a, b*) are modified by welding or brazing secondary bucket links 89*a, b* to main links 80*a, b*. Thus, secondary bucket links 890*a, b* serve as mounting brackets for clamp links 16*a, b*. Links 89*a, b* fabricated in a machine shop or other facility, and then used directly. Holes 93*a, b*, which extend through both main bucket links 80*a, b* and secondary bucket links 89*a, b*, in one embodiment, line up with new clamp link holes 52*a, b*, when the clamp links 16*a, b* are pivoted about permanent clamp link pins 14*a, b* to the retracted or storage position (FIGS. 3B and 3C). "Permanent" clamp link pins are inserted through clamp link pin holes 91*a, b* as shown in FIG. 7 ("b" side only). The pins are "permanent" in the sense that they may not be easily removed without the use of proper tools. Of course, subsequent to extended use of the backhoe attachment, remachining of some parts may be preferable for efficient operation. Thus, "permanent" is to be construed as a relative term. Clamp link holes 91*a, b* are positioned to maximize mechanical advantage for the clamping device. Holes 91*a, b* are positioned closer to holes 85*a, b* to holes 81*a, b*, generally the ratio of distances ranging from about 2:1 to about 4:1 measured from the diameter of the respective holes. The result achieves the maximum clamp leverage with the available amount of stroke. Typically, in the embodiment shown in FIG. 7, pins having diameter equal to or somewhat smaller than holes 93*a, b* are inserted through main bucket links 80*a, b*, secondary bucket links, 89*a, b* and new clamp link holes 52*a, b* in clamp links 16*a, b*. The design of the pin to be inserted is not critical. One embodiment of a clamp link is shown in phantom in FIG. 7 in its immobilized, locked position. Other locking mechanisms can be envisioned and are considered within the scope of this invention, most notably a resilient latch 92*a, b* which could be attached to secondary bucket links 89*a, b*, latch 92*a, b* being made of a sufficiently resilient material which can reversibly grasp the clamp links and hold them temporarily in an immobilized position. Latch 92*a, b* could be metal, plastic or other resilient material and attached by screws to links 89*a, b* or formed integrally thereon.

It can be seen that the clamping device of the present invention meets the requirements of the clamping device according to FIGS. 1 and 2 with added simplicity of operation, no chance of losing pins or kidney links, and allows full movement of the bucket to its natural curled position, without the chance of breaking or crimping pieces of the clamping device itself. Maximum jaw opening limiting mechanisms may be employed to prevent the danger of "locking out" as disclosed in U S. Pat. No. 4,519,739, as well as minimum opening limiting mechanisms similar to those in this patent. Particular applications of these features include the prevention of being unable to return the clamping device to full closure, with the further advantages of picking up and placement of plastic pipe, fragile containers, or the like, or where repeated lifting operations must be performed on objects of the same size.

The alternate embodiment of the method of temporarily immobilizing the clamp links to the bucket links in the storage mode is shown in phantom in FIG. 7. Also, simple use of a wire or suitable twine or rope could be inserted through holes 93*a, b*, 52*a, b* and wrapped around the alternate clamping mechanism shown in phantom in FIG. 7. These methods of immobilizing the clamp links 16*a, b* with respect to the backhoe are considered within the scope of the appended claims.

While this invention has been described in connection with the preferred embodiments thereof, it is obvious that modifications and changes therein may be made by those skilled in the art to which it pertains without departing from the spirit and scope of the invention. For example, the clamp arms could be equipped with various kinds of gripping "teeth" for particular applications, or no teeth at all, as in the case of lifting particularly fragile items. In addition, the clamp arms could be shaped to accommodate any specific item, and since the device is easily removed and replaced, the unit could be returned to its standard operating mode without difficulty. Accordingly, the scope of this invention is to be limited only by the appended claims.

What is claimed is:

1. Apparatus for attachment to a backhoe for conversion thereof to a clamping device, said backhoe having a bucket, a dipper arm and a pair of bucket links, said bucket being pivotally coupled to said bucket links along a first pivot axis, said bucket links being pivotally coupled to said dipper arm along a second pivot axis, and said bucket being pivotally coupled to said sipper arm along a third pivot axis, said apparatus comprising:

a mounting bracket mounted on each bucket link;

a pair of clamp links, one end portion of each clamp link being pivotally and substantially permanently coupled to one of said mounting brackets along a fourth pivot axis which is closer to said second pivot axis than to said first pivot axis;

said bucket links having means for temporarily immobilizing said clamp links at a position adjacent the respective bucket link when said bucket is positioned adjacent the dipper arm;

a pair of clamp arms, each clamp arm being pivotally coupled to one of said clamp links along a fifth pivot axis, said clamp arms also being pivotally coupled to said dipper arm; and support webbing interconnecting said clamp arms, said support webbing comprising a bottom plate extending between and generally perpendicular to said clamp arms, a pair of clamp link guides positioned parallel to and spaced from said clamp arms, said clamp link guides welded to said bottom plate, guide gussets extending perpendicular to and connecting the clamp arms and clamp link guides, clamp arm gussets positioned generally parallel to said guide gussets and generally perpendicular to said clamp arms, a center reinforcement member extending under and in contact with said bottom plate and extending between said clamp arms, and a stop member extending between clamp arms, said support webbing connecting said clamp arms so that it permits said bucket to travel to a full closed arc position without interference between the dipper arm and clamp arms.

2. The apparatus of claim 1 wherein said clamp arms are pivotally coupled to said dipper arm along said third pivot axis.

3. The apparatus of claim 1 wherein said stop member constitutes means for limiting the range of pivotal movement of said clamp arms.

4. The apparatus of claim 1 further comprising a plurality of holes at different locations along said clamp arms to permit adjustment of the position of said fifth pivot axis.

5. The apparatus of claim 1 wherein the ratio of the distance between said fourth and first pivot axes to that between the said fourth and second pivot axes ranges from 2:1 to 4:1.

6. The apparatus of claim 1 further comprising means for securing said clamp arms against said dipper arm when said bucket is positioned adjacent the dipper arm.

7. The apparatus of claim 6 wherein said securing means comprises a pin and a clamp bracket, the clamp bracket including a plate coupled to said dipper arm, said plate having a through hole for releasably receiving said pin when said clamp arms are pivoted toward and positioned adjacent to said dipper arm to secure said clamp arms in a retracted position.

8. The apparatus of claim 7 wherein said clamp links and clamp arms include through holes for releasably receiving said pin when said clamp arms are pivoted away from said dipper arm.

9. The apparatus of claim 1, wherein said immobilizing means comprises a pair of resilient latches on each of said bucket links.

10. The apparatus of claim 1 where said stop member is a box tube.

11. A method of converting a backhoe to a clamping device while allowing full movement of a bucket attachment, said backhoe having a bucket, a dipper arm and a pair of bucket links, said bucket being pivotally coupled to said bucket links along a first pivot axis, said bucket links being pivotally coupled to said dipper arm along a second pivot axis, and said bucket being pivotally coupled to said dipper arm along a third pivot axis, said method comprising:

providing a pair of clamp links;

permanently mounting one end of each clamp link to one of said bucket links in a pivotal manner at a point of attachment closer to said second pivot axis than to said first pivot axis;

temporarily mounting a second end of each of said respective clamp links to one of a pair of clamp arms in a pivotal manner;

interconnecting said clamp arms with support webbing comprising a bottom plate extending between clamp link arms and perpendicular to said arms, a pair of clamp link guides positioned parallel to and spaced away from said arms, said guides welded to said bottom plate, a pair of guide gussets extending generally perpendicular to and connecting the respective clamp arms and clamp link guides, clamp arm gussets positioned generally parallel to said guide gussets, center reinforcement means extending between said clamp arms under and ion contact with said bottom plate, and a stop member extending between said clamp arms for limiting pivotal movement of said clamp arms; and pivotally mounting each of said clamp arms to said dipper arm.

12. The method of claim 11 wherein said clamp arms are pivotally mounted to said dipper arm along said third pivot axis.

13. The method of claim 11 wherein said stop member is formed with a box tube.

* * * * *